US010654306B1

(12) United States Patent
Melendez

(10) Patent No.: US 10,654,306 B1
(45) Date of Patent: May 19, 2020

(54) CONGRATULATORY CARD THAT DISPENSES CONFETTI

(71) Applicant: Joshua Melendez, Cape Coral, FL (US)

(72) Inventor: Joshua Melendez, Cape Coral, FL (US)

( * ) Notice: Subject to any disclaimer, the term of this patent is extended or adjusted under 35 U.S.C. 154(b) by 0 days.

(21) Appl. No.: 16/742,184

(22) Filed: Jan. 14, 2020

(51) Int. Cl.
*B42D 15/04* (2006.01)
*A63H 37/00* (2006.01)

(52) U.S. Cl.
CPC ..... *B42D 15/045* (2013.01); *A63H 37/00* (2013.01)

(58) Field of Classification Search
CPC .. B42D 15/045; A63H 37/00; B65D 73/0078; B65D 73/0092
See application file for complete search history.

(56) References Cited

U.S. PATENT DOCUMENTS

| | | | | |
|---|---|---|---|---|
| 4,140,317 | A * | 2/1979 | Ramney | A63F 9/001 229/72 |
| 4,787,160 | A * | 11/1988 | Balsamo | B42D 15/045 206/469 |
| 5,199,745 | A * | 4/1993 | Balsamo | G09F 1/04 206/469 |
| 9,027,269 | B2 * | 5/2015 | Budzar | B42D 25/22 40/124.03 |
| 10,322,599 | B1 * | 6/2019 | Stimac | B42D 15/045 |
| 2004/0181980 | A1 * | 9/2004 | Gardi | B42D 15/045 40/124 |
| 2004/0198503 | A1 * | 10/2004 | Fairweather | A63H 37/00 472/52 |
| 2010/0223821 | A1 * | 9/2010 | Bogal | A47G 33/06 40/124.06 |

* cited by examiner

*Primary Examiner* — Gary C Hoge
(74) *Attorney, Agent, or Firm* — Ruben Alcoba, Esq.

(57) ABSTRACT

A congratulatory card that dispenses confetti paper. The congratulatory card is made using a tissue, a confetti paper, a rectangular card, a double sided tape, a ribbon, and a sticker. The congratulatory card is used by placing it on a ceiling or wall and pulling the ribbon when a user wishes to open the card and release the confetti paper.

4 Claims, 6 Drawing Sheets

Step 3:
Fold the tissue paper
over the back of the card,
enclosing the confetti creating the pouch Flip the pouch on its back.
Flip the sticker and stick
on the front of the pouch,
leaving a half inch
perimeter (For ripping).

CONGRATULATORY CARD THAT DISPENSES CONFETTI

BACKGROUND

The present disclosure relates to a congratulatory card that dispenses confetti.

The inventor of the present invention conceived the present invention while preparing for one of his children's birthday.

The invention is a congratulatory card that, when opened, releases confetti to a surrounding environment.

The card allows a user to stick the card on a wall or ceiling so that when the card is opened confetti is released downward and outward from the card.

The inventor conceived the invention so that his child would be showered with confetti upon being congratulated on her birthday.

For the foregoing reasons, there is a need for the congratulatory card that dispenses confetti.

SUMMARY

The present invention is a congratulatory card that dispenses confetti when opened.

A congratulatory card that dispenses confetti, the card is comprised of a tissue paper having a first and a second side; a confetti paper that is placed on a central portion of the first side of the tissue paper; a rectangular card that is placed on top of the confetti paper and the first side of the tissue paper, wherein each corner of the rectangular card touches a side of the tissue paper, and wherein areas of the tissue paper that are not covered by the rectangular card are folded over the rectangular card; a double sided tape, a first side of the double sided tape is placed over and attached to the folded over tissue paper and a second side of the double sided tape is covered with a film until it is ready for attachment to a wall or ceiling; a ribbon that is placed transversely on the second side of the tissue paper; and a sticker that secures that ribbon on the second side of the tissue paper so that when the ribbon is pulled the second side of the tissue paper is ripped open, thereby releasing the confetti to an environment.

An object of the present invention is to provide an economical manner of delivering confetti using a congratulatory card.

Another object of the present invention is to provide a congratulatory card that can be placed on walls and ceilings to surprise people being celebrated with a card and confetti paper.

DRAWINGS

These and other features, aspects, and advantages of the present invention will become better understood with regards to the following description, appended claims, and drawings where:

DESCRIPTION

Figure 1:
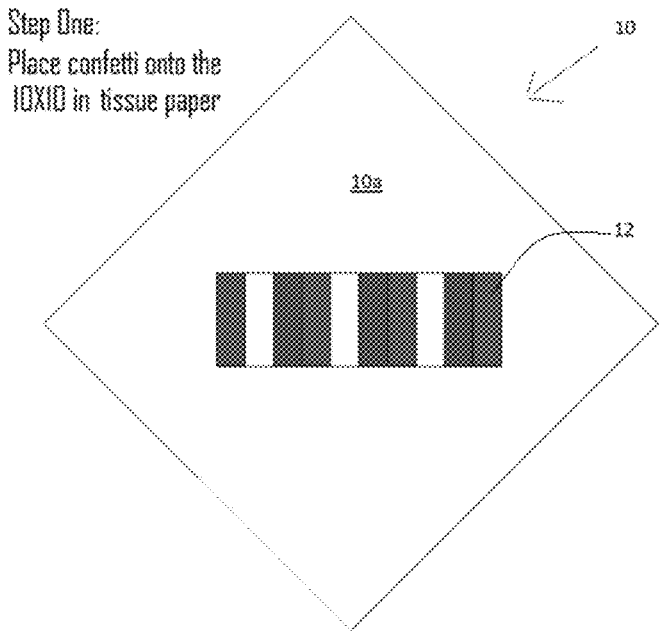
FIG. 1 shows a tissue paper placed on a surface.
Figure 2:
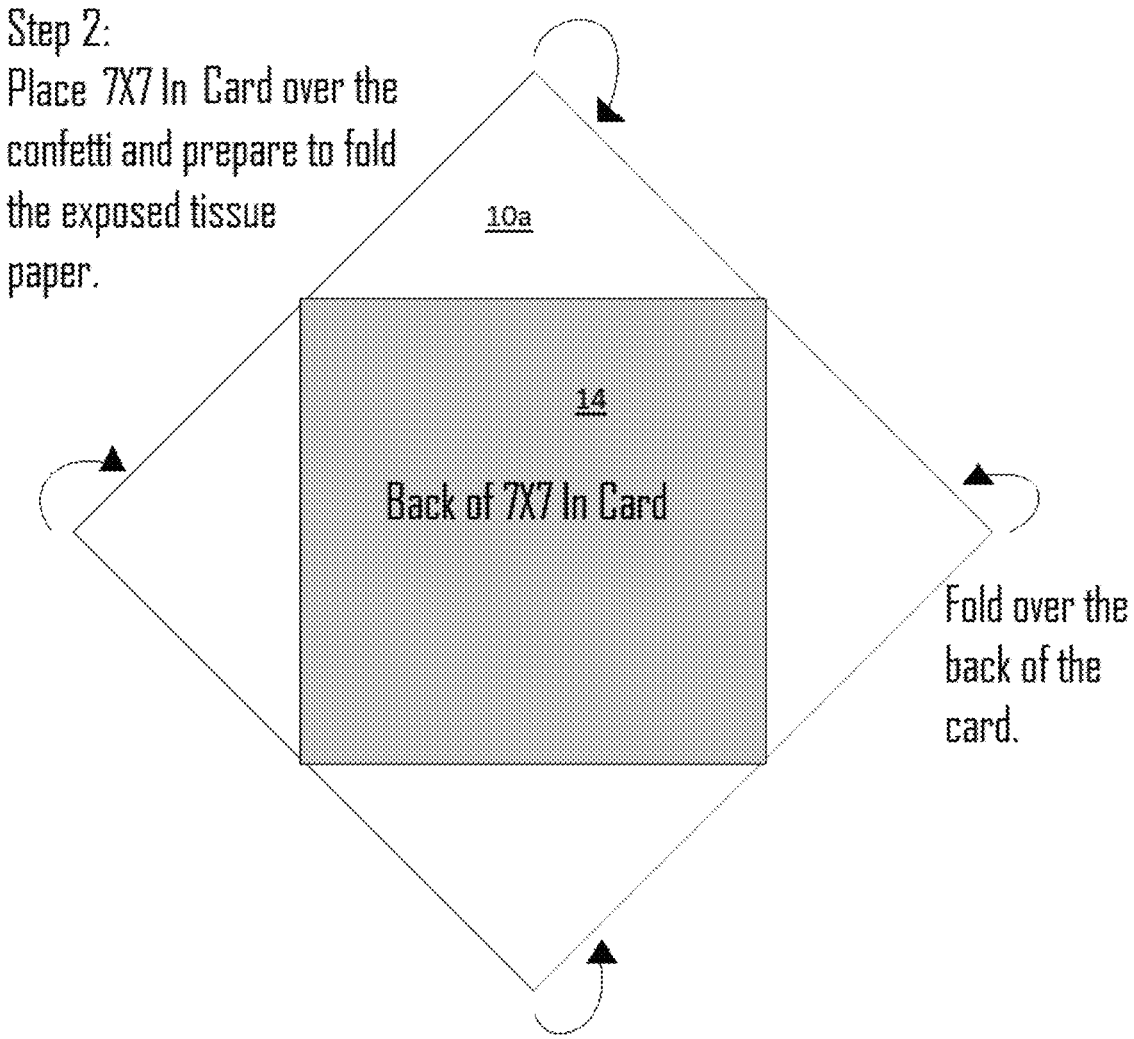
FIG. 2 shows a card being placed over the confetti paper and the card.
Figure 3:
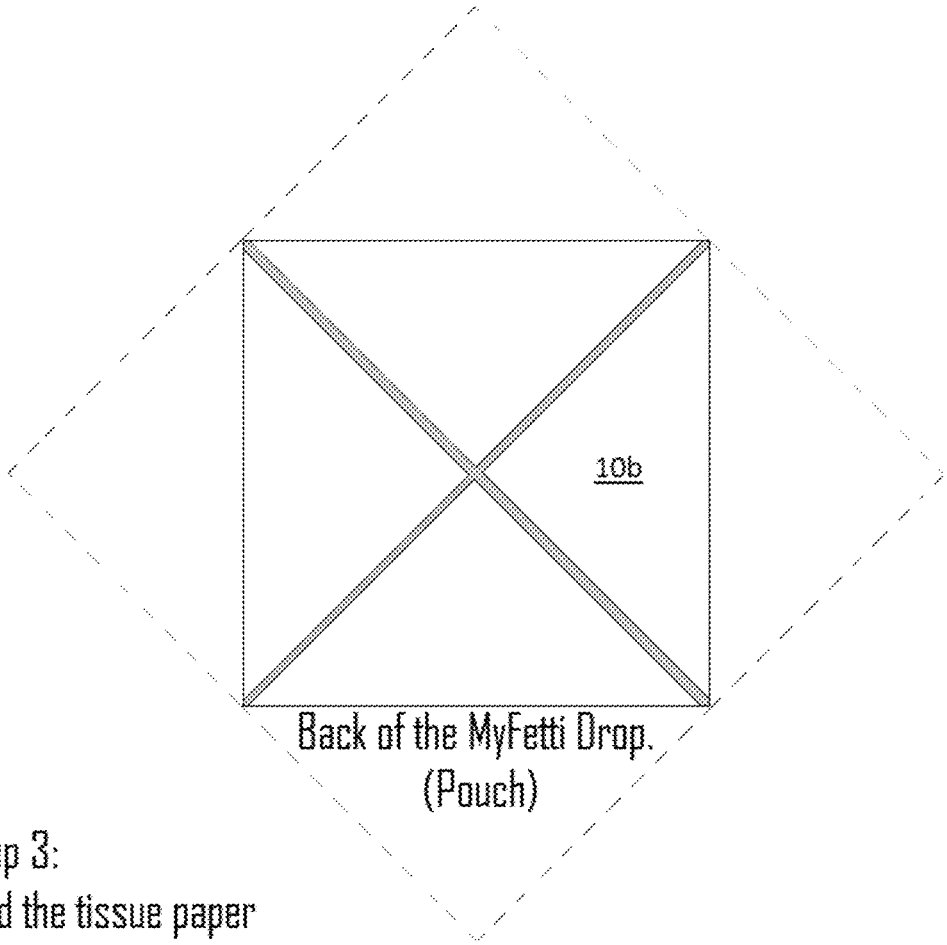
FIG. 3 shows how the tissue paper if folded over the card.
Figure 4:
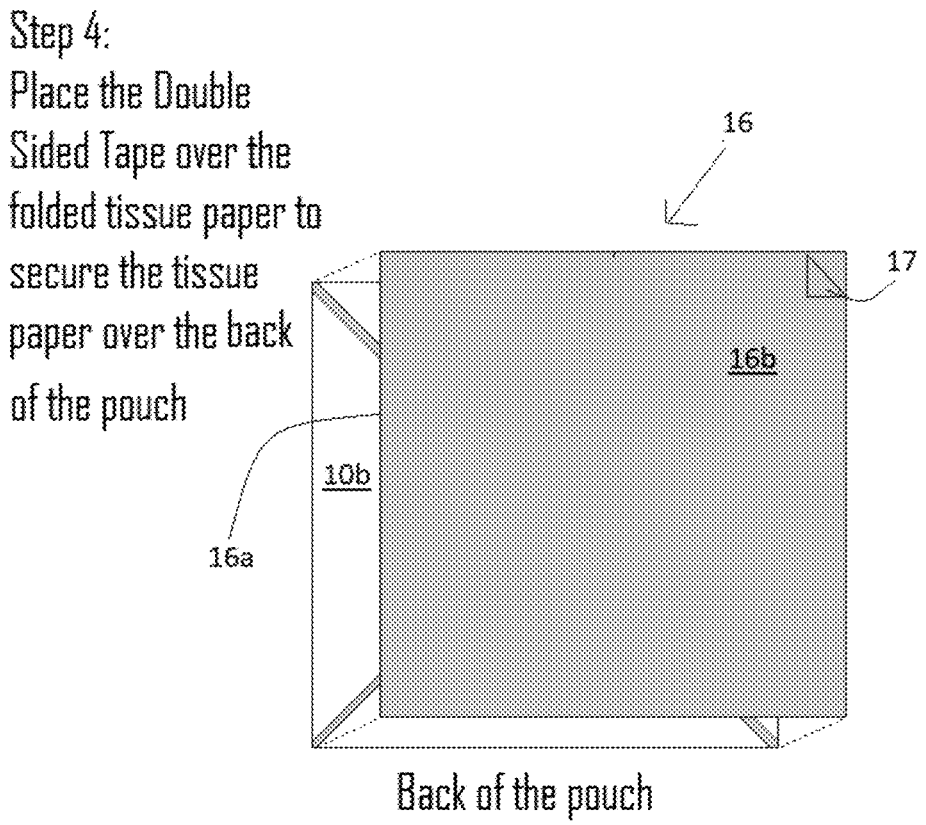
FIG. 4 shows how a double sided paper is placed and attached to the folded over tissue Paper, thereby forming a pouch.
Figure 5:
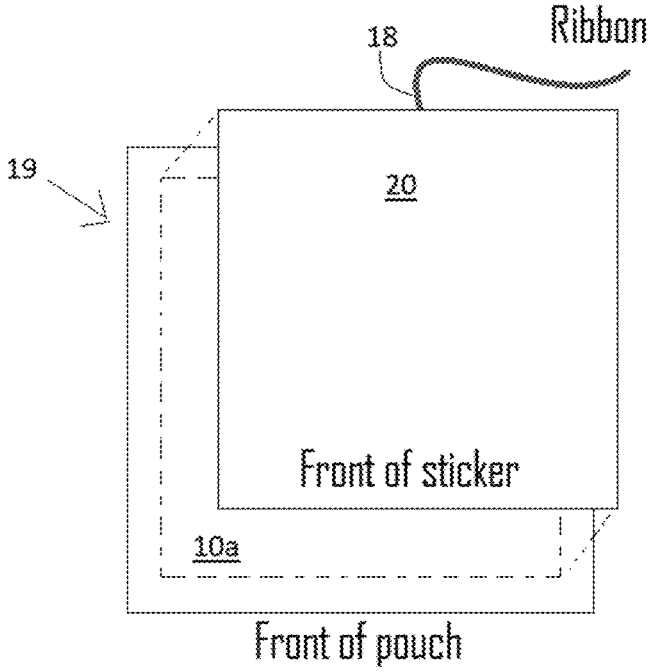
FIG. 5 shows, how the ribbon and the sticker are attached to the pouch.
Figure 6:
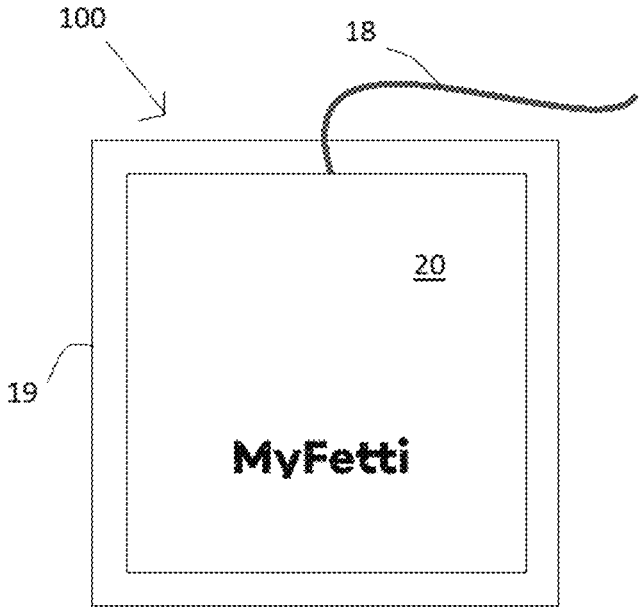
FIG. 6 shows the present invention.

As seen in FIGS. 1-6, the present invention is a congratulatory card that dispenses confetti.

A congratulatory card 100 comprised of a tissue paper 10 having a first 10*a* and a second side 10*b*. A confetti paper 12 that is placed on a central portion of the first side 10*a* of the tissue paper 10. A rectangular card 14 that is placed on top of the confetti paper 12 and the first side 10*a* of the tissue paper 10, wherein each corner of the rectangular card 14 touches a side of the tissue paper 10, and wherein areas of the tissue paper 10 that are not covered by the rectangular card 14 are folded over the rectangular card 14. A double sided tape 16, a first side 16*a* of the double sided tape 16 is placed over and attached to the folded over tissue paper 10*b* and a second side 16*b* of the double sided tape 16 is covered with a film 17 until it is ready for attachment to a wall or ceiling. A ribbon 18 that is placed transversely on the second side 10*b* of the tissue paper 10. And, a sticker 20 that secures that ribbon 18 on the second side 10*b* of the tissue paper 10 so that when the ribbon 18 is pulled the second side 10*b* of the tissue paper 10 is ripped open, thereby releasing the confetti 12 to an environment.

In a preferred embodiment, the tissue paper 10 measures ten inches by ten inches and the rectangular card 14 measures seven inches by seven inches.

A method of making a congratulatory card 100 that dispenses confetti paper. The method comprises the steps of providing a tissue paper 10 that has a first 10*a* and a second side 10*b*, a confetti paper 12, a card 14, a double sided tape 16 that has a first side 16*a* and a second side 16*b*, a ribbon 18, and a sticker 20. Placing the tissue paper 10 over a flat surface so that its first side 10*a* is exposed. Placing the confetti paper 12 on a central portion of the first side 10*a* of the tissue paper 10. Placing a rectangular card 14 on top of the confetti paper 12 and the first side 10*a* of the tissue paper 10 and ensuring that each corner of the rectangular card 14 touches a side of the first side 10*a* of the tissue paper 10, and folding the areas of the tissue paper 10*b* not covered by the rectangular card 14 over the rectangular card 14. Placing and attaching the first side 16*a* of the double sided tape 16 over the tissue paper 10*b* that was folded over the rectangular card 14, thereby creating a pouch 19. Flipping the pouch 19 so that the second side 10*b* of the tissue paper 10 is exposed. Placing the ribbon 18 transversely on the second side 10*b* of the tissue paper 10. And, placing and adhering the sticker 20 over the ribbon 18 and the second side 101) of the tissue paper 10 so that when the ribbon 18 is pulled the second side 10*b* of the tissue paper 10 is ripped open, thereby releasing the confetti paper 12 to an environment.

The present invention is used by taking the film of the second side of the double sided tape and adhering the second side to a wall or ceiling so that the ribbon hangs downward from the congratulatory card. The confetti is released from the congratulatory card when the ribbon is pulled downward and the tissue is torn by the ribbon.

An advantage of the present invention is that it provides an economical manner of delivering confetti using a congratulatory card.

Another advantage of the present invention is that it provides a congratulatory card that is placed on walls and ceilings to surprise people being celebrated with a card and confetti.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed:

1. A congratulatory card that dispenses, confetti, the card is comprised of a tissue paper having a first and a second side;

a confetti paper that is placed on a central portion of the first side of the tissue paper;

a rectangular card that is placed on top of the confetti paper and the first side of the tissue paper, wherein each corner of the rectangular card touches a side of the tissue paper, and wherein areas of the tissue paper that are not covered by the rectangular card are folded over the rectangular card;

a double sided tape, a first side of the double sided tape is placed over and attached to the folded over tissue paper and a second side of the double sided tape is covered with a film until it is ready for attachment to a wall or ceiling;

a ribbon that is placed transversely on the second side of the tissue paper;

and a sticker that secures that ribbon on the second side of the tissue paper so that when the ribbon is pulled the second side of the tissue paper is ripped open, thereby releasing the confetti paper to an environment.

2. The congratulatory card that dispenses confetti of claim 1, wherein the tissue paper is perforated.

3. The congratulatory card that dispenses confetti of claim 2, wherein the tissue paper measures ten inches by ten inches, and the rectangular card measures seven inches by seven inches.

4. A method of making a congratulatory card that dispenses confetti, the method comprises the steps of:

providing a tissue paper that has a first and a second side, a confetti paper, a card, a double sided tape that has a first side and a second side, a ribbon, and a sticker;

placing the tissue paper over a flat surface so that its first side is exposed;

placing the confetti paper on a central portion of the first side of the tissue paper;

placing a rectangular card on top of the confetti paper and the first side of the tissue paper and ensuring that each corner of the rectangular card touches a side of the first side of the tissue paper, and folding the areas of the tissue paper not covered by the rectangular card over the rectangular card;

placing and attaching the first side of the double sided tape over the tissue paper that was folded over the rectangular card, thereby creating a pouch;

flipping the pouch so that the second side of the tissue paper is exposed;

placing the ribbon transversely on the second side of the tissue paper; and placing and adhering the sticker over the ribbon and the second side of the tissue paper so that when the ribbon is pulled the second side of the tissue paper is ripped open, thereby releasing the confetti paper to an environment.

* * * * *